US009550615B2

(12) United States Patent
Miller

(10) Patent No.: US 9,550,615 B2
(45) Date of Patent: Jan. 24, 2017

(54) RATCHET TOOL DISPLAY PACKAGE

(75) Inventor: Jonathan Miller, Burlington, CT (US)

(73) Assignee: STANLEY BLACK & DECKER, INC., New Britain, CT (US)

( * ) Notice: Subject to any disclaimer, the term of this patent is extended or adjusted under 35 U.S.C. 154(b) by 1557 days.

(21) Appl. No.: 12/792,250

(22) Filed: Jun. 2, 2010

(65) Prior Publication Data

US 2011/0297568 A1 Dec. 8, 2011

(51) Int. Cl.
*B65D 73/00* (2006.01)

(52) U.S. Cl.
CPC ..... *B65D 73/0014* (2013.01); *B65D 73/0064* (2013.01)

(58) Field of Classification Search
CPC ..... B65D 73/0014; B65D 73/0064
USPC ..... 206/376, 377, 378, 379; 248/317
See application file for complete search history.

(56) References Cited

U.S. PATENT DOCUMENTS

| | | | | |
|---|---|---|---|---|
| 1,675,171 | A | 6/1928 | Fegley et al. | 248/158 |
| 1,681,107 | A | 8/1928 | Fegley et al. | 248/158 |
| 4,450,961 | A | 5/1984 | Bies et al. | 206/349 |
| 4,586,615 | A * | 5/1986 | Quitmann | 211/70.6 |
| 4,899,877 | A | 2/1990 | Kiernan | 206/349 |
| 5,190,154 | A * | 3/1993 | Reusch | 206/375 |
| 5,477,964 | A | 12/1995 | Hart | 206/349 |
| 5,484,056 | A | 1/1996 | Wood | 206/349 |
| 5,501,330 | A * | 3/1996 | Betts | 206/349 |
| D376,312 | S | 12/1996 | Cahn et al. | D9/415 |
| D420,577 | S | 2/2000 | Steel et al. | D9/415 |
| D429,461 | S | 8/2000 | Rowlay | D9/415 |
| D438,462 | S | 3/2001 | Nichol | D9/415 |
| 6,241,092 | B1 * | 6/2001 | Vasudeva | 206/349 |
| 6,283,311 | B1 | 9/2001 | Lee | 211/70.6 |
| 6,315,119 | B1 | 11/2001 | Lee | 206/349 |
| 6,425,482 | B1 | 7/2002 | Chiang | 206/349 |
| 6,637,591 | B2 * | 10/2003 | Chen | 206/349 |
| 6,834,767 | B1 | 12/2004 | Lin | 211/70.6 |
| 6,883,767 | B1 * | 4/2005 | Huang | 248/317 |
| 6,907,990 | B2 * | 6/2005 | Hu | 206/378 |
| 6,932,223 | B1 | 8/2005 | Lee et al. | 211/70.6 |
| 6,935,516 | B2 | 8/2005 | Chiang | 211/70.6 |

(Continued)

FOREIGN PATENT DOCUMENTS

| | | |
|---|---|---|
| DE | 102007039978 B3 | 10/2008 |
| EP | 1 652 789 | 5/2006 |

OTHER PUBLICATIONS

Extended Search Report as issued for European Patent Application No. 11167724.1, dated Sep. 20, 2011.

*Primary Examiner* — Anthony Stashick
*Assistant Examiner* — Ernesto Grano
(74) *Attorney, Agent, or Firm* — Pillsbury Winthrop Shaw Pittman LLP

(57) ABSTRACT

Packaging for a ratchet tool is disclosed. The packaging comprises a display structure, a ratchet retaining portion and a securement portion. The display structure may be arranged to be mounted for display. The ratchet portion retaining structure may be configured to engage a ratchet portion of the tool in a manner that prevents rotation of the ratchet portion. The securement portion may be configured to secure the tool to the display structure to prevent removal of the tool from the display package, while permitting movement of a handle portion of the tool relative to the ratchet portion while the ratchet portion is fixed from movement by the retaining structure.

19 Claims, 7 Drawing Sheets

(56) References Cited

U.S. PATENT DOCUMENTS

| | | | | |
|---|---|---|---|---|
| 7,100,777 | B1 * | 9/2006 | Kao | 211/70.6 |
| 7,175,151 | B2 | 2/2007 | Chang | 248/689 |
| 7,210,663 | B2 | 5/2007 | Wheeler et al. | 248/309.1 |
| 7,344,118 | B2 | 3/2008 | Samberg | 248/690 |
| 7,392,902 | B2 | 7/2008 | Chang | 206/349 |
| 7,434,700 | B2 | 10/2008 | Kao | 211/70.6 |
| 7,611,013 | B2 | 11/2009 | Leventhal et al. | 206/463 |
| 7,762,161 | B2 * | 7/2010 | Lai | 81/63.1 |
| 2004/0256262 | A1 | 12/2004 | Wheeler et al. | |
| 2008/0029420 | A1 * | 2/2008 | Tong | 206/495 |
| 2011/0209584 | A1 * | 9/2011 | Suter | 81/60 |

* cited by examiner

RATCHET TOOL DISPLAY PACKAGE

FIELD OF THE INVENTION

The present invention relates generally to display packaging for retail sale.

BACKGROUND OF THE INVENTION

Display packaging is widely used to mount articles for point of purchase displays. For a consumer, the packaging serves to provide information about the article. For instance, a customer may rely on information included on the packaging, such as depictions of the functions and features of the article in order to make an informed purchasing decision. The display of such information on the packaging may also aid the manufacturer and the retailers of the article; increasing the likelihood of a sale through the consumers informed purchasing decision. Additionally, the packaging of an article may be useful for marketing purposes, and may serve as a marketing platform. The coloring of the packaging, and the use of trademarks and other branding, may increase the likelihood of sale through brand recognition.

In some display packages, articles may be mounted so that one or more features of the article may be accessed by a consumer. Such a mounting is often accompanied by attention grabbing verbiage on the package, such as "Try Me," indicating that a consumer is able to and should attempt to experiment with the functionality of the product. This degree of accessibility may be desirable, since it may attract consumer attention by allowing consumers to both see and experience the operation of the article. The resulting attraction may convince the consumer to purchase the article in lieu of another article. Among other things, the present application relates to a unique ratchet tool display package that allows consumer access to the handle of the ratchet tool, while allowing the user to test the ratcheting action.

SUMMARY OF THE INVENTION

According to one aspect of the invention, packaging for a ratchet tool may comprise a display structure arranged to be mounted for display of the ratchet tool. The packaging may also have a ratchet portion retaining structure fixed relative to the display structure. The retaining structure may have a size and shape configured so that it may engage a ratchet portion of the tool in a manner that prevents rotation of the ratchet portion. The package may further have a securement portion connected to the display structure. The securement portion may be configured to secure the tool to the display structure in a Manner that permits a handle portion of the tool to be moved relative to the ratchet portion of the tool while the ratchet portion of the tool is fixed from movement by the retaining structure.

Another aspect of the invention may be a method for displaying a ratchet tool in a display package. Such a method may comprise securing a ratchet portion of the tool with a ratchet retaining structure, wherein the ratchet retaining structure has a size and shape configured to engage the ratchet portion in a manner that prevents rotation of the ratchet portion. The method may also comprise securing the tool to the display structure with a securement portion in a manner that permits a handle portion of the tool to be moved relative to the ratchet portion of the tool, while the ratchet portion of the tool is fixed from movement by the retaining structure.

Another aspect of the invention may be a ratchet tool display package comprising a ratchet tool and packaging. The ratchet tool may include a handle portion and a ratchet portion, wherein the handle portion arranged for movement relative to the ratchet portion. The packaging may comprise a display structure arranged to be mounted for display of the ratchet tool. The packaging may also include a ratchet portion retaining structure fixed relative to the display structure, wherein the retaining structure having a size and shape configured to engage the ratchet portion of the tool in a manner that prevents rotation of the ratchet portion. The packaging may also include a securement portion connected to the display structure and configured to secure the tool to the display structure in a manner that permits a handle portion of the tool to be moved relative to the ratchet portion of the tool while the ratchet portion of the tool is fixed from movement by the retaining structure.

These and other objects, features, and characteristics of the present invention, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. In one embodiment of the invention, the structural components illustrated herein are drawn to scale. It is to be expressly understood, however, that the drawings are for the purpose of illustration and description only and are not a limitation of the invention. In addition, it should be appreciated that structural features shown or described in any one embodiment herein can be used in other embodiments as well. It is to be expressly understood, however, that the drawings are for the purpose of illustration and description only and are not intended as a definition of the limits of the invention. As used in the specification and in the claims, the singular form of "a", "an", and "the" include plural referents unless the context clearly dictates otherwise.

BRIEF DESCRIPTION OF THE DRAWINGS

Features of the invention are shown in the drawings, in which like reference numerals designate like elements. The drawings form part of this original disclosure in which.

DETAILED DESCRIPTION OF THE ILLUSTRATED EMBODIMENT(S)

Figure 1:
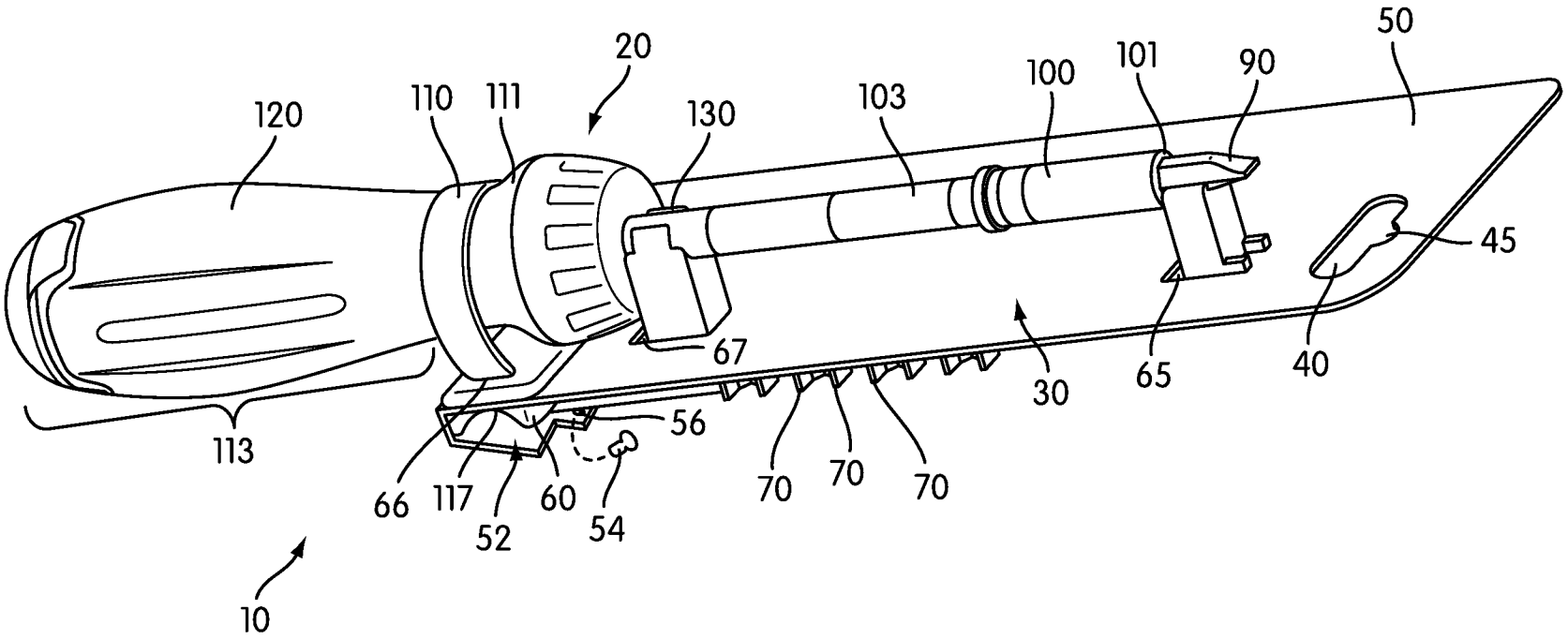
FIG. 1 is a perspective view of an embodiment of a display package of the present invention, comprising packaging and a mounted ratchet tool.

FIG. 1 shows an embodiment of a ratchet tool display package 10 in accordance with one embodiment of the present invention. The ratchet tool display package 10 includes a ratchet tool 20 and packaging 30. The ratchet tool 20 may be of any type, including but not limited to a multi-bit ratchet tool. In some embodiments, the ratchet tool 20 may be a multi-bit ratcheting screwdriver. The packaging 30 is arranged to be mounted for the display of the ratchet tool 20. The packaging 30 may be of any suitable materials, including but not limited to paper materials (for example, cardstock), plastic materials, or combinations thereof.

In an embodiment, the packaging 30 may comprise a mounting aperture 40. The mounting aperture 40 may be of any appropriate size or shape, and may be configured to hang the package on a display hook at a point of sale. As illustrated, in one embodiment the mounting aperture 40 is elongated with rounded edges, having an additional smaller recess 45 at the top for a display hook to settle into when the package 10 is mounted for display. Such a configuration is useful so that a store employee stocking a plurality of packages 10 does not need to exercise as great a degree of care in threading the mounting aperture 40 with the display hook In one embodiment, the packaging 30 may include a display structure 50 that may be sized and shaped so that information about the ratchet tool 20, such as branding, marketing information and/or sales information (i.e. a price or a UPC code) may be displayed. Such a display structure 50 may be of any suitable construction or configuration, including but not limited to paper products, plastic products, or combinations thereof. The display structure 50 may be of a backing card configuration and have a generally flat or planar configuration, may or may not be of uniform thickness, and in an embodiment may be at least partially curved or bent. In an embodiment, the display structure 50 may be configured to be supported substantially perpendicular to the display hook when the package 10 is mounted for display. In some embodiments, the mounting aperture 40 may be an integral part of or connected to the display structure 50. In an embodiment the display structure 50 may be considered to be a display card. In an embodiment, the display structure 50 may be supported by a frame structure 60, which in an embodiment may comprise a rigid structure configured to support non-rigid elements of the packaging 30, and/or interconnect other portions of the packaging 30, as will be described in greater detail below. In an embodiment, the printed information that may be on the display structure 50 may be printed directly thereon, or printed on another material (e.g., paper with an adhesive backing) and secured to the display structure 50.

The packaging 30 also includes a ratchet portion retaining structure 90 fixed relative to the display structure 50. In one embodiment, as shown, the retaining structure 90 is separately formed (e.g., from plastic) and then secured to the display structure 50. In another embodiment, the retaining structure 90 may be integrally formed with the display structure 50 (e.g., both integrally molded from plastic) so that the two structures are thus fixed relative to one another. The retaining structure 90 is sized and shaped to engage a ratchet portion 100 of the tool 20 in a manner that prevents rotation of the ratchet portion 100. The retaining structure 90 may be of any appropriate shape or construction, including but not limited to a frictional retainer or a coupling retainer, and may be constructed of suitable materials, including but not limited to plastic, metal, and rigid paper products. In an embodiment, the display structure 50 may comprise an aperture 65, so that the ratchet retaining portion 90 can extend through the display structure 50 (from the back side to the front side of the display structure 50 as shown).

Figure 2:
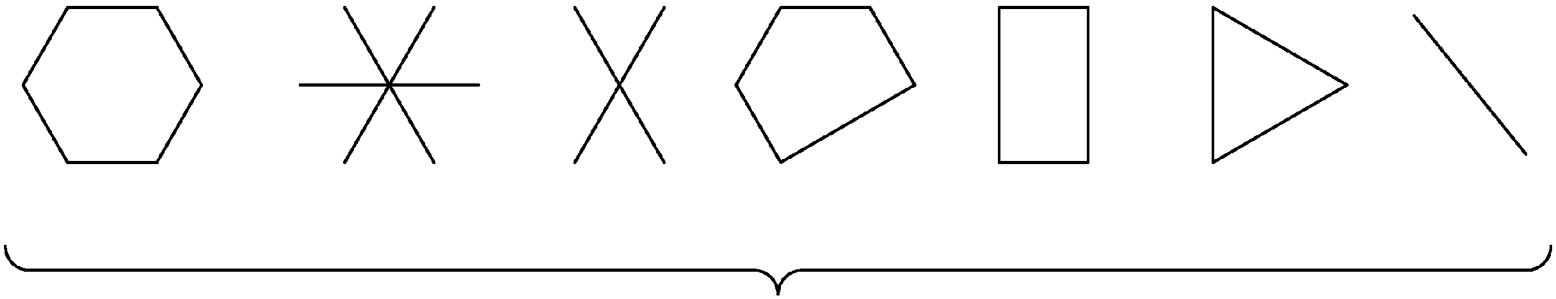
FIG. 2 shows schematic views of various embodiments of a portion of a ratchet retaining structure of the display package of the present invention.

In the illustrated embodiment, wherein the ratchet portion 100 of the ratchet tool 20 contains a bit receiving recess 101 configured to accept a selected one of a plurality of bits, the retaining structure 90 may have at least a portion thereof shaped as one of the bits so that it can be received within the recess 101 of the ratchet portion 100. Although the illustrated embodiment shows a hexagonal retaining structure 90 that can be received in recess 101, any number of shapes for the retaining structure 90 may be used. As seen in the non-limiting examples of FIG. 2, such shapes may have hexagon, star, cross, pentagon, square, triangle, or linear configurations, as non-limiting examples. Any structure that prevents rotation of the ratchet portion 100 may be used.

In another embodiment, wherein the ratchet portion 100 of the tool 20 comprises a probe or male configuration adapted to couple with female attachments, such as sockets, the retaining structure 90 may be shaped to couple to an outer surface of the probe or male shaped surface of the ratchet portion 100. For example, the retaining structure 90 may comprise a recess configured to envelop a male ratchet structure of the ratchet portion 100. In an embodiment wherein the male ratchet structure comprises a ball detent, the retaining structure 90 may comprise a groove within the recess configured to receive the ball detent to couple the tool 20 to the retaining structure 90.

As seen in the illustrated embodiment of FIG. 1, wherein the ratchet tool 20 is a multi-bit ratcheting screwdriver, the ratchet retaining structure 90 may generally take the shape of a screwdriver bit (and thus appear as a "false" bit). Such a shape may be aesthetically appealing to consumers, and allow them to appreciate how the ratchet tool 20 would look in an operational mode with an actual bit attached. In an embodiment, the ratchet retaining structure 90 may comprise an actual bit, wherein the bit is fixedly held in place as it is coupled to the ratchet portion 100, preventing rotation of the ratchet portion 100 with respect to the packaging 30 while the ratchet tool 20 is in the package 10. In such embodiments, the actual bit may be configured to be removable from the package 10, along with the ratchet tool 20, outside the point of sale, following purchase of the ratchet tool 20. Removal of the actual bit may require destruction of a portion of the ratchet retaining structure 90 to release the actual bit.

In another embodiment, the retaining structure 90 may be configured to engage the ratchet portion 100 of the tool 20 in a frictional manner. Such a retaining structure 90 may be configured to frictionally prevent rotation of the ratchet portion 100 by engaging the exterior of the ratchet portion 100. In an embodiment wherein the ratchet portion 100 of the tool 20 contains a recess, the retaining structure 90 may be configured to frictionally prevent rotation of the ratchet portion 100 by engaging the recess.

The packaging 30 may also include a securement portion 110, which may also be connected to (separately formed and connected or by being integrally formed with) the display structure 50. The securement portion 110 may be configured to secure the tool 20 to the display structure 50 in a manner that permits a handle portion 120 of the tool 20 to be moved (e.g. rotated) relative to the ratchet portion 100 of the tool 20 while the ratchet portion 100 is fixed from movement by the retaining structure 90. In an embodiment, the display structure 50 may comprise an aperture 66 so that the securement portion 110 can extend through the display structure 50 (from the back side to the front side of the display structure 50 as shown).

The securement portion 110 may be of any suitable form or construction, including but not limited to a locking clip, a zip tie, a twist tie, a C-clamp, a molded loop, and so on. As seen in the illustrated embodiment, if the handle portion 120 of the tool 20 contains an annular concavity 111, the securement portion 110 may be configured to encircle the handle portion 120 about the concavity 111. The securement portion 110 thus may limit movement of the tool 20 relative to the packaging 30, while permitting the handle portion 120 of the tool 20 to rotate relative to the ratchet portion 100 of the tool 20. In an embodiment, the handle portion 120 of the tool 20 may be partially or completely outside the packaging 30, so as to permit access to the handle portion 120 by a consumer. For example, in the illustrated embodiment, a hand engaging portion 113 extends below the card or display region 50.

Figure 3:
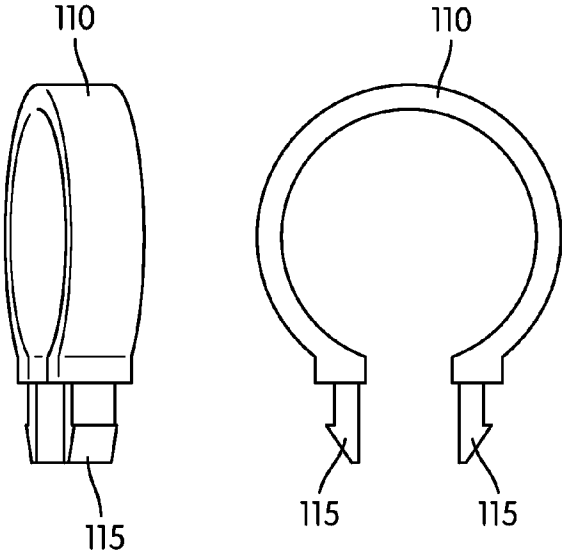
FIG. 3 shows front and side views of an embodiment of a securement portion of the embodiment of FIG. 1.

In an embodiment, the securement portion 110 may be configured to not be easily removable once fixed relative to the display structure 50. Such a configuration may be utilized for purposes of inventory management, indicia of point of sale control, or for any other reason. As seen in the embodiment of FIG. 3, showing several isolated views of the securement portion 110, the securement portion 110 can comprise at least one locking ratchet 115. Specifically, each locking ratchet 115 may comprise a stepped wedge portion configured to enter a corresponding receptacle 117, as illustrated in FIG. 1, which in an embodiment may correspond with the aperture 66 of the display package 50, wherein either or both of the locking ratchet 115 and the receptacle 117 have sufficient give to allow insertion of the locking ratchet 115 into the receptacle 117 (i.e. through the aperture 66), however the directionality of the stepped wedge portion hinders or prevents subsequent removal of the securement portion 110. In an embodiment, destruction of the securement portion 110, or of another portion of the package 10, may be required for removal of the securement portion 110 and/or removal of the tool 20 from the packaging 30, such as when the securement portion comprises a zip tie or a locking clip. As another example, the securement portion 110 may comprise a molded loop, such as a solid loop of a durable material formed around the handle 120 and through the packaging 30 once the tool 20 is placed in the packaging 30. In another embodiment, the securement portion 110 may be fused to the display structure 50, or to any other portion of the packaging 30.

As seen in the illustrated embodiment, the display structure 50 may further comprise or be connected to a wrap portion 52, which may be configured to substantially surround the locking receptacle 117, to prevent access to the locking ratchets 115 that are locked therein. As shown in the illustrated embodiment, wherein the display structure 50 comprises a backing card configuration, the wrap portion 52 may comprise a foldable portion of the card, configured to fold around the portion of the frame structure 60 that comprises the locking receptacle 117. In an embodiment, the packaging 30 may further comprise a rivet 54, that may enter an aperture 56 in the wrap portion 52 and lock into another portion of the display structure 50, including, in the illustrated embodiment, a portion of the frame structure 60. The rivet 54 may be configured to hinder unfolding of the wrap portion 52, preventing access to the locking ratchets 115, to discourage removal of the ratchet tool 20.

As the illustrated embodiment also shows, the packaging 30 may optionally include a support structure 130, configured to further support the ratchet tool 20. For example, in the illustrated embodiment, the ratchet tool 20 comprises a shaft 103. In an embodiment, the shaft 103 may be part of the ratchet portion 100, and thus may rotate with respect to the handle 120 (i.e. the ratcheting action occurs in the handle 120). In another embodiment, the shaft 103 may connect the ratchet portion 100 to the handle 120, wherein the ratchet portion 100 may rotate with respect to the shaft 103 and handle 120 (i.e. the ratcheting action occurs in the shaft 103). In some embodiments, such as that shown in FIG. 1, the support structure 130 may support the shaft 103. In other embodiments, the support structure 130 may support the ratchet portion 100 or a portion of the handle 120. The support structure 130 may be of any suitable form, including but not limited to a locking clip, a zip tie, a C-clamp, a molded loop, a post, and so on. The support structure 130 may be fixed relative to the packaging 30, and may be configured to support the ratchet tool 20 so that, in combination with the retaining structure 90, the ratchet tool 20 is held substantially parallel to the display structure 50. In an embodiment, the display structure 50 may comprise an aperture 67 so that the support structure 130 can extend through the display structure (i.e. from the back side to the front side as shown).

Figure 4:
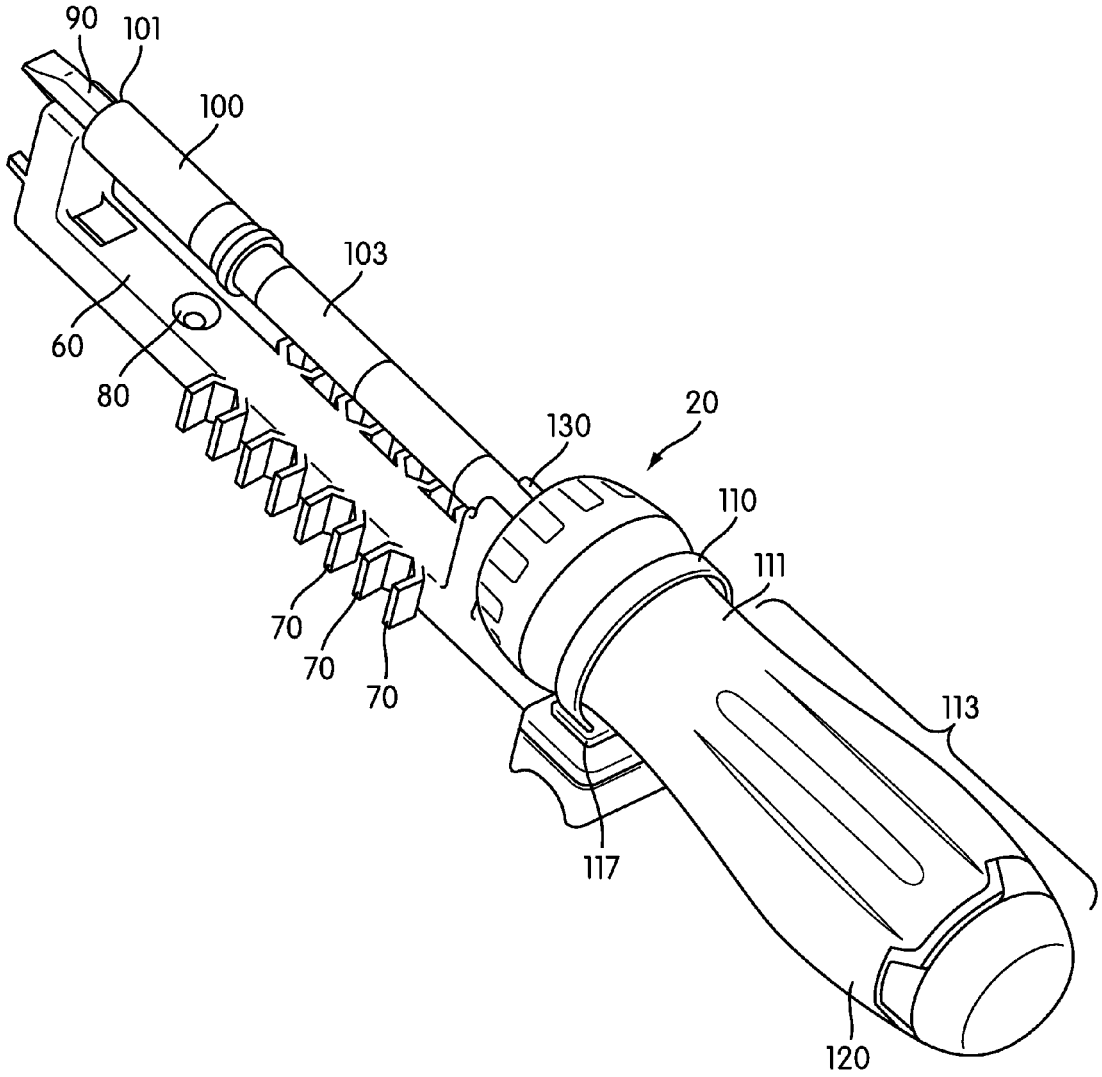
FIG. 4 is an isolated perspective view of a portion of the embodiment of FIG. 1, with a mounted ratchet tool.

FIG. 4 shows a perspective view of a portion of the package 10 of FIG. 1, with the mounted ratchet tool 20, omitting at least a portion of the display structure 50 of that illustrated embodiment. As shown, the packaging 30 may also comprise a frame structure 60 that connects to or integrates the aforementioned ratchet portion retaining structure 90 and securement portion 110. In an embodiment, the frame structure 60 may be a portion of the display structure 50. In an embodiment, the ratchet portion retaining structure 90 and securement portion 110 may be independent structures that are not connected to one another. In an embodiment, as shown, the ratchet portion retaining structure 90 and the securement portion 110 may be incorporated as part of the frame structure 60. In an embodiment, the frame structure 60 may include ribbing 70 that may be configured to support the display structure 50. In embodiments where at least a portion of the display structure 50 comprises a flexible material such as card stock, such ribbing 70 may structurally support a back side of the material, to inhibit flexing the display structure 50.

In one embodiment, as illustrated, the frame structure 60, support structure 130, and ratchet portion regaining structure 90 may be integrally formed as a single plastic molded structure. However, in another embodiment, these parts can be separately formed and otherwise connected to the packaging 30 (or to help form the packaging 30). In some embodiments the packaging 30 and/or the frame structure 60 may be configured to be mounted to a wall or other surface. In an embodiment, the frame structure 60 may comprise at least one mounting hole 80, through which screws, nails, or other fasteners may be placed. In an embodiment, the ribbing 70 may be shaped to receive attachments for the ratchet tool 20, including but not limited to bits, for storage of said attachments. In some embodiments, one or more of the packaging 30, the frame structure 60, the retaining structure 90, and the securement portion 110 may be configured such that the tool 20 may be mounted to the packaging 30 and/or the frame structure 60 while packaging 30 and/or the frame structure 60 are mounted flush to the wall or other surface. As an example, the frame structure 60 may have a sufficient depth so that when mounted flush to the wall or other surface, the wall or other surface do not interfere with the handle 120, preventing the tool 20 from being displayed or stored in the packaging 30 and/or frame structure 60.

In embodiments wherein the packaging 30 and/or the frame structure 60 are configured to be mounted to a wall or other surface following purchase of the tool 20, the support structure 130 may be configured to removably hold the tool 20, following removal (or destruction) of the securement portion 110. In an embodiment, the support structure 130 may be configured to frictionally hold the tool 20 to the packaging 30 and/or the frame structure 60 against the force of gravity. In an embodiment wherein the mounting is such that the tool 20 is supported against the force of gravity by the retaining structure 90 (i.e. holding the handle portion 120 above the ratchet portion 100), the support structure 130 may be configured to support the ratchet portion 100 from slipping out of the retaining structure 90, for example, due to the force of gravity on the unbalanced weight of the handle portion 120.

Figure 5:
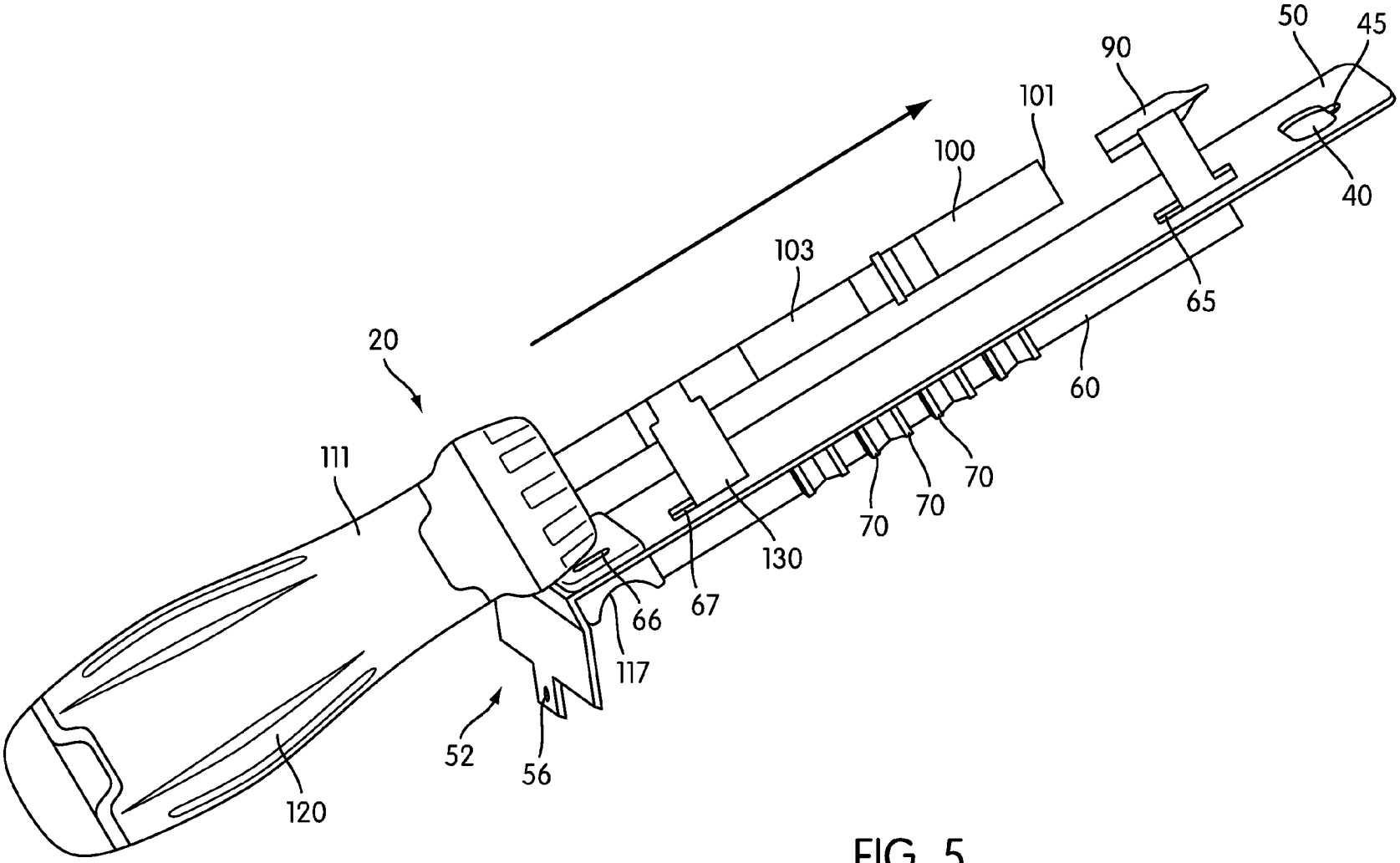
FIG. 5 is a perspective view of a step in mounting the ratchet tool into the display package of FIG. 1.

Another aspect of the present invention is a method for displaying the ratchet tool 20 in the display package 10. In an embodiment, the method may include securing the ratchet portion 100 of the tool 20 with a ratchet retaining member 90 that is fixed relative to the packaging 30. This may be accomplished by any suitable means. As seen in the non-limiting example of FIG. 5, securing the ratchet portion 100 may comprise sliding the ratchet tool 20 along the packaging 30 so that the ratchet portion 100 couples with the ratchet retaining member 90.

Figure 6:
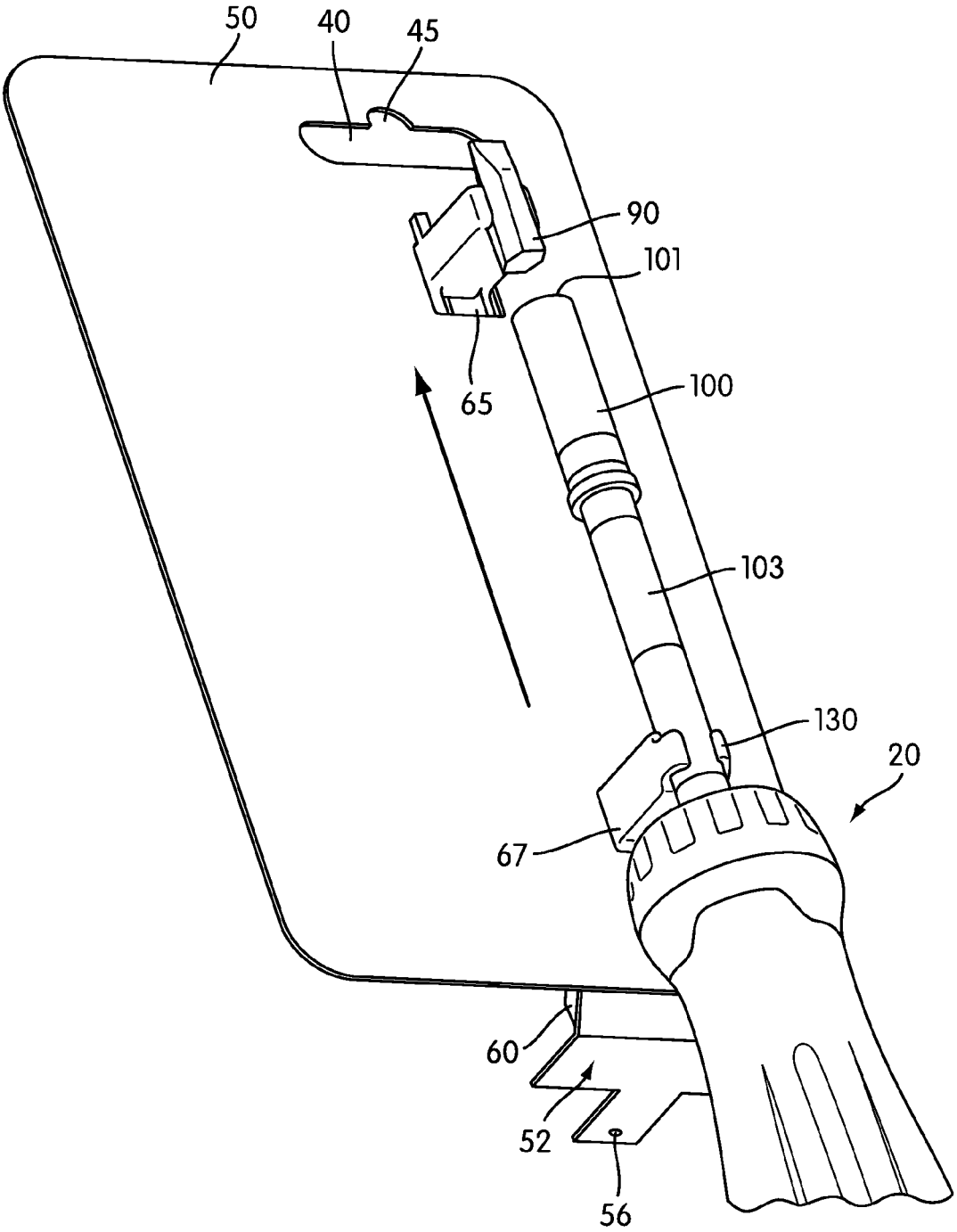
FIG. 6 is an perspective view of the step of mounting the ratchet tool into the display package of FIG. 5.

In embodiments wherein the package 10 comprises the support structure 130, if the support structure 130 comprises a closed loop, sliding the ratchet portion 100 along the packaging 30 may entail sliding the ratchet portion 100 through the closed loop of the support structure 130, before securing the ratchet portion 100 with the ratchet retaining member 90. In an embodiment wherein the support structure 130 comprises an open clip, such as that seen in FIG. 6, securing the ratchet portion 100 may comprise clipping an area of the ratchet portion 100, such as the shaft 103 in some embodiments, to the support structure 130, before sliding the ratchet portion 100 to secure the ratchet portion 100 with the ratchet retaining member 90. As a non-limiting example, such an open support structure 130 may be useful if the area of the ratchet portion 100 configured to couple with the ratchet retaining member 90, such as female recess 101, has a larger radial size than that of the area of the ratchet portion 100 configured to be supported by the support structure 130, so that the support structure 130 can be of a smaller radial size.

In embodiments such as those where the ratchet retaining member 90 may be configured to couple with female recess 101 of the ratchet portion 100 of the tool 20, securing the ratchet portion 100 in the ratchet retaining member 90 may comprise coupling the ratchet portion 100 with the ratchet retaining member 90. Depending on the orientation of such a female recess in the ratchet portion 100, coupling the ratchet portion 100 with the ratchet retaining member 90 may comprise rotating the ratchet portion 100 with respect to the handle portion 120 (or together with the handle portion by rotation of the handle portion itself), so as to align the ratchet portion 100 with the ratchet retaining member 90 and enable the proper coupling of the two portions. In an embodiment, securing the ratchet portion 100 of the tool 20 may comprise partially or completely surrounding the ratchet retaining structure 90 with the ratchet portion 100. In another embodiment, securing the ratchet portion 100 of the tool 20 may comprise partially or completely surrounding the ratchet portion 100 with the ratchet retaining structure 90.

Figure 7:
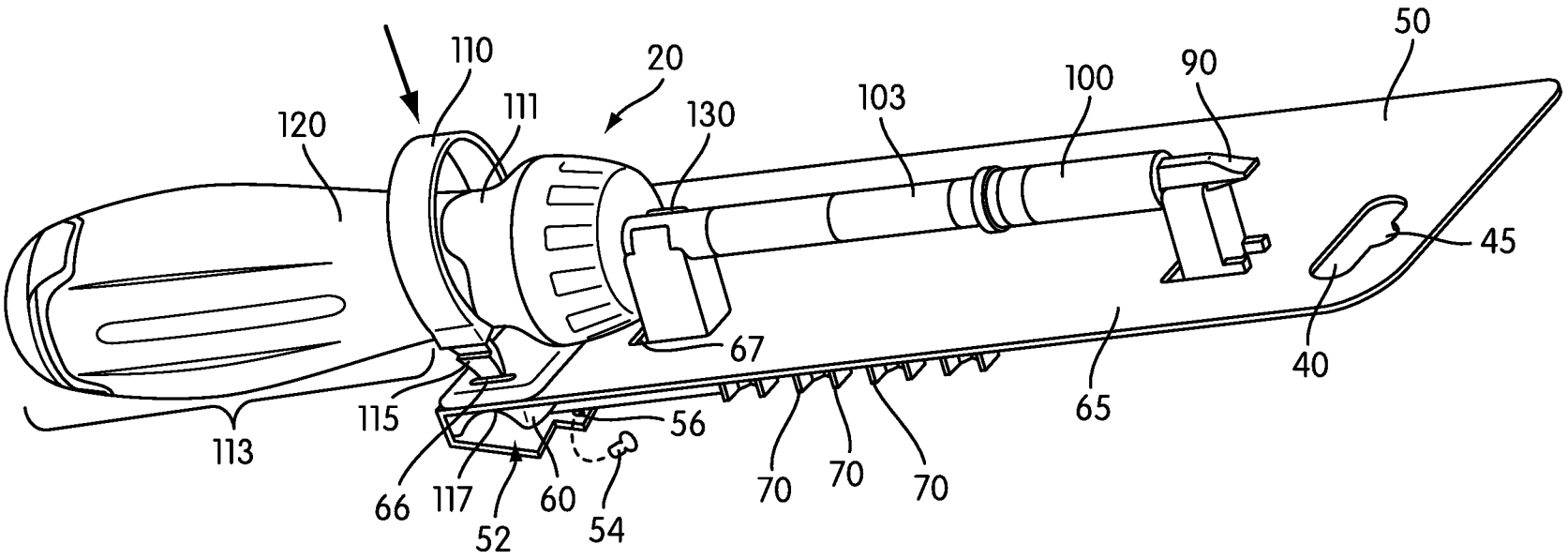
FIG. 7 is a side perspective view of another step in mounting the ratchet tool into the display package of FIG. 5.

The method for displaying the ratchet tool 20 in the display package 10 may further comprise securing the ratchet tool 20 to the packaging 30 with the securement portion 110, as seen in FIG. 7, which shows the securement portion 110 in the process of being inserted around the tool 20 into the aperture 66. In an embodiment, such securement may be done in a manner that permits the handle portion 120 of the tool 20 to be moved relative to the ratchet portion 100 of the tool 20, while the ratchet portion 100 is fixed from movement by the retaining structure 90. As illustrated, securing the ratchet tool 20 to the packaging 30 may comprise encircling or partially encircling a portion of the tool 20 by the securement portion 110, confining the movement of the tool 20 between the securement portion 110 and the packaging 30. In an embodiment, the handle portion 120 of the tool 20 may be partially or completely outside or below the display structure 50, so as to permit access to the handle by a consumer. In an embodiment wherein the handle portion 120 of the tool 20 comprises the concavity 111, securing the ratchet tool 20 to the packaging 30 may comprise securing the securement portion 110 around the concave portion of the handle portion 120 so as to further limit movement of the ratchet tool 20.

In an embodiment wherein the securement portion 110 comprises at least one locking ratchet 115, securing the ratchet tool 20 to the packaging 30 may comprise inserting the locking ratchet 115 into at least one receptacle 117 in the packaging 30, so that the locking ratchet 115 may lock the securement portion 110 into place. In an embodiment wherein the packaging 30 comprises a display structure 50 and a frame structure 60, the aperture 66 may be sized and positioned on the display structure 50 to receive the locking ratchet 115, so as to provide the locking ratchet 115 access to the frame structure 60 on the other side of the display structure 50.

Figure 8:
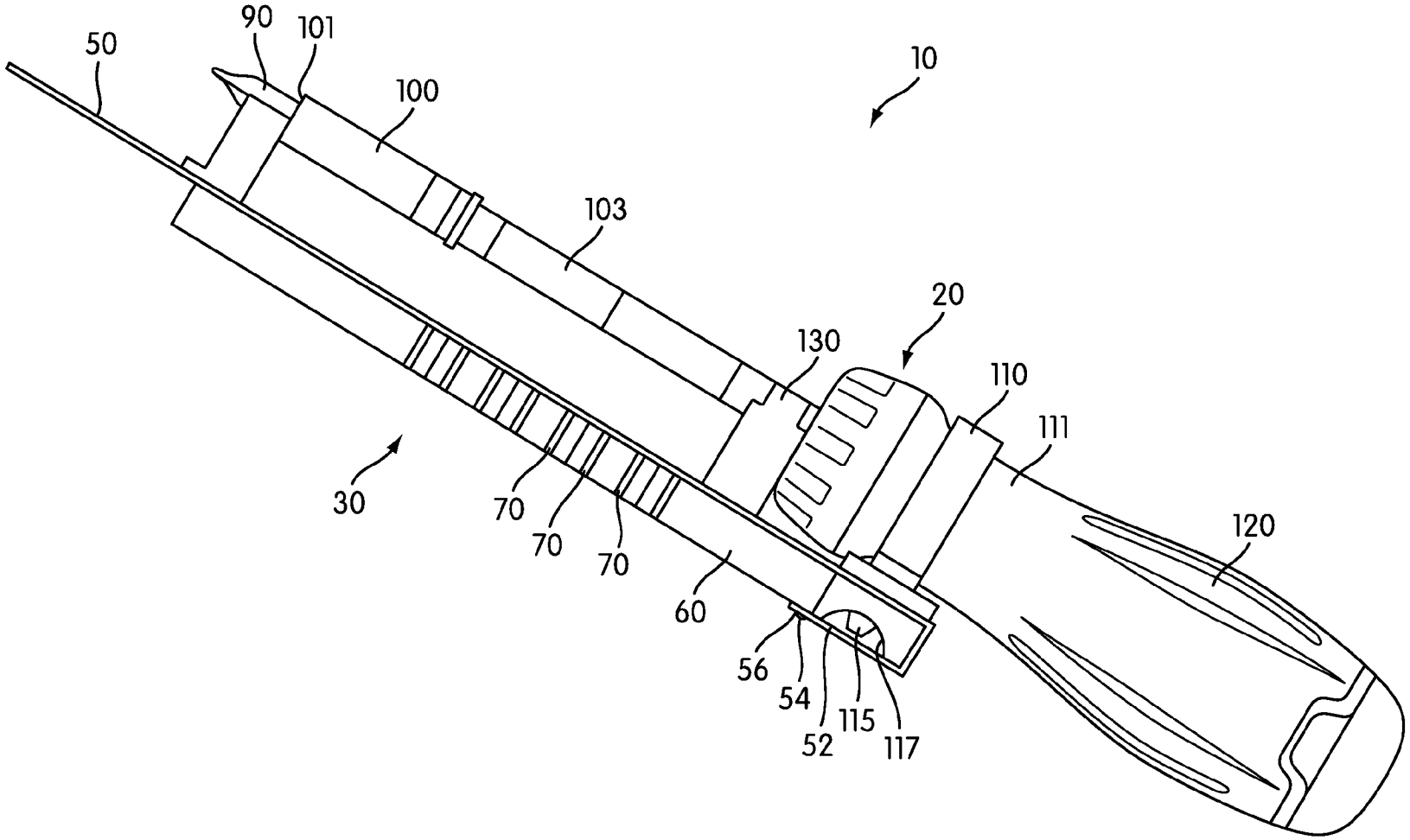
FIG. 8 is a side view showing the mounted ratchet tool in the display package of FIG. 5.

As seen in the side view of the display package 10 in FIG. 8, by inserting the securement portion 110 into the packaging 30, the locking ratchet 115 of the securement portion 110 may lock into the locking receptacle 117 in the frame structure 60. By locking the securement portion 110 around the tool 20 in this way, in particular around the concavity 111 such as that seen on the handle portion 120, the tool 20 may be restricted from lateral movement away from the packaging 30, thus securing the tool 20 in the display package 10 for display at the point of sale. As FIG. 8 further shows, folding the wrap portion 52 around the locking receptacle 117 may prevent access to the locking ratchets 115, further preventing removal of the tool 20 from the packaging 30 at the point of sale. By inserting the rivet 54 through the aperture 56 of the wrap portion 52, and locking the rivet 54 into the display structure 50 (such as the frame structure 60), the securement portion 110 may be further secured around the concavity 111, further deterring removal of the tool 20 prior to purchase.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. Packaging for a ratchet screwdriver, comprising:

a display structure arranged to be mounted for display of the ratchet screwdriver;

a ratchet portion retaining structure fixed relative to the display structure, the retaining structure having a size and shape configured to slidably engage a ratchet portion of the ratchet screwdriver in a manner that prevents rotation of the ratchet portion;

a securement portion connected to the display structure and configured to secure a handle of the screwdriver to the display structure in a manner that permits the handle of the screwdriver to be rotated relative to the ratchet portion of the screwdriver while the ratchet portion of the screwdriver is fixed from movement by the retaining structure, by encircling a portion of the handle.

2. The package of claim 1, wherein the ratchet portion retraining structure comprises a coupling piece configured to couple inside a recess in the ratchet portion of the ratchet screwdriver.

3. The package of claim 2, wherein the coupling piece is shaped as a hexagon, star, cross, pentagon, square, triangle, or a line.

4. The package of claim 2, wherein the ratchet screwdriver is a multi-bit ratchet screwdriver, and wherein the coupling piece is generally shaped as a bit for the multi-bit ratchet screwdriver.

5. The package of claim 1, further comprising a support structure fixed relative to the display structure, the support structure configured to support the ratchet portion of the ratchet screwdriver, wherein the support structure holds the ratchet portion substantially perpendicular to the retaining structure.

6. The package of claim 1, wherein the retaining structure is comprised of plastic, paper products, metal, or combinations thereof.

7. The package of claim 1, wherein the securement portion comprises a locking clip configured to prevent removal of the ratchet screwdriver from the package.

8. The package of claim 7, wherein the locking clip is comprised of plastic, paper products, metal, or combinations thereof.

9. The package of claim 1, wherein the securement portion is configured to engage an opening in the display structure to encircle the portion of the handle of the ratchet screwdriver when the ratchet screwdriver is mounted for display on the display structure.

10. The package of claim 1, wherein the display structure comprises a mounting aperture configured to hang the package on a display hook.

11. The package of claim 10, wherein the display structure comprises a planar portion sized to display information about the ratchet screwdriver.

12. The package of claim 11, wherein the display structure is configured to be substantially perpendicular to the display hook when the display structure is mounted to the display hook.

13. The package of claim 1, wherein the display structure and the ratchet portion retaining structure are connected by being integrally formed together.

14. The package of claim 1, wherein the display structure and the ratchet portion regaining structure are connected by being separately formed then connected together.

15. The package of claim 1, wherein the display structure and the securement portion are connected by being integrally formed together.

16. The package of claim 1, wherein the display structure and the securement portion are connected by being separately formed then connected together.

17. The package of claim 1, wherein the ratchet portion retaining structure and the securement portion are connected by being integrally formed together.

18. The package of claim 1, wherein the ratchet portion retaining structure and the securement portion are connected by being separately formed then connected together.

19. A ratchet tool display package comprising:

a ratchet tool, including a handle portion and a ratchet portion, the handle portion arranged for movement relative to the ratchet portion;

a display structure arranged to be mounted for display of the ratchet tool;

a ratchet portion retaining structure fixed relative to the display structure, the retaining structure having a size and shape configured to slidably engage the ratchet portion of the tool in a manner that prevents rotation of the ratchet portion;

a securement portion connected to the display structure and configured to secure the tool to the display structure in a manner that permits a handle portion of the tool to be rotated relative to the ratchet portion of the tool while the ratchet portion of the tool is fixed from movement by the retaining structure, by encircling the handle portion of the tool.

* * * * *